US005634309A

United States Patent [19]

Polen

[11] Patent Number: 5,634,309

[45] Date of Patent: Jun. 3, 1997

[54] PORTABLE DANCE FLOOR

[76] Inventor: Rodney C. Polen, 900 SW. 62nd Blvd. #D22, Gainesville, Fla. 32607

[21] Appl. No.: 335,736

[22] PCT Filed: May 14, 1992

[86] PCT No.: PCT/US92/04069

§ 371 Date: Nov. 14, 1994

§ 102(e) Date: Nov. 14, 1994

[87] PCT Pub. No.: WO93/23638

PCT Pub. Date: Nov. 25, 1993

[51] Int. Cl.[6] ..... E04F 15/06

[52] U.S. Cl. ..... 52/392; 52/127.8; 52/177; 52/390; 52/591.1; 52/592.1; 52/DIG. 4; 52/403.1; 52/458

[58] Field of Search ..... 52/480, 506.1, 52/177, 403.1, DIG. 4, 586.2, 586.1, 390, 391, 392, 457, 458, 127.8, 127.7, 127.11

[56] References Cited

U.S. PATENT DOCUMENTS

| | | | |
|---|---|---|---|
| 841,490 | 1/1907 | Montier | 52/591.2 |
| 2,138,085 | 11/1938 | Birtles . | |
| 2,490,577 | 12/1949 | Brown | 52/591.1 |
| 2,999,431 | 9/1961 | Mitchell . | |
| 3,077,426 | 2/1963 | Johnston | 52/591.2 X |
| 4,575,984 | 3/1986 | Versteeg | 52/591.2 |
| 4,598,008 | 7/1986 | Maeda | 52/591.2 X |
| 4,635,425 | 1/1987 | Covo | 52/591.2 X |
| 4,895,080 | 1/1990 | Thomas | 52/591.1 X |
| 4,909,718 | 3/1990 | Payne | 52/591.2 X |

FOREIGN PATENT DOCUMENTS

| | | |
|---|---|---|
| 2264627 | 7/1972 | Germany . |

*Primary Examiner*—Carl D. Friedman
*Assistant Examiner*—W. Glenn Edwards
*Attorney, Agent, or Firm*—Arthur G. Yeager; Earl L. Tyner

[57] ABSTRACT

A dance floor of assemblable square sections that are held together magnetically and are aligned by male/female couplers and ramp members attachable to the outer perimeter of the assembled square sections.

20 Claims, 4 Drawing Sheets

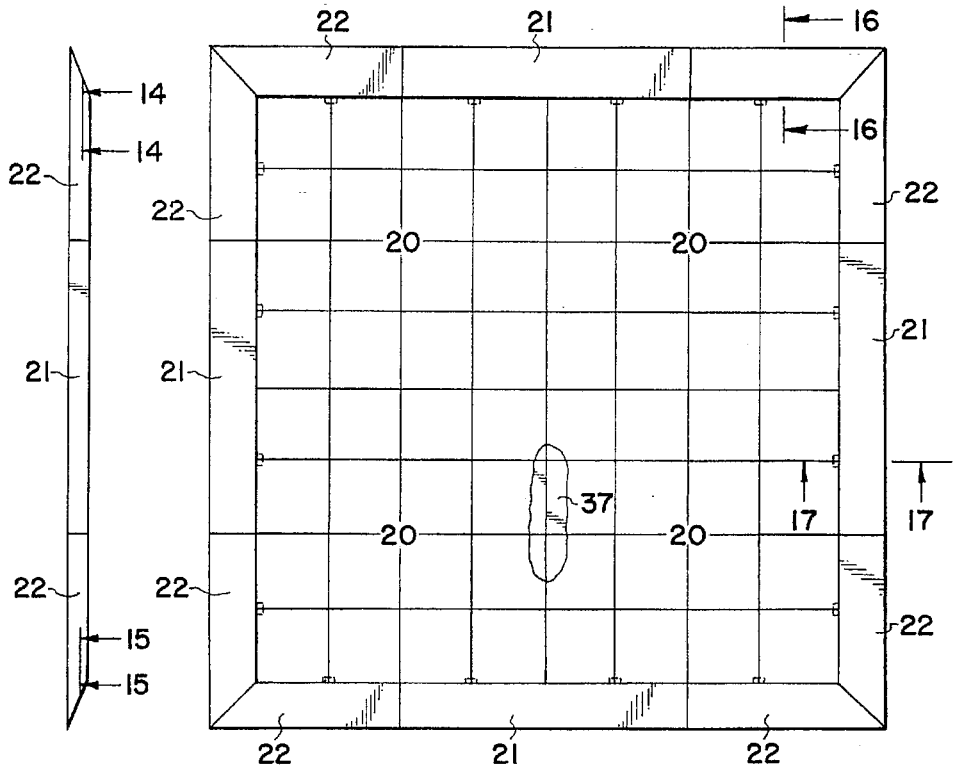
FIG 2
FIG 1
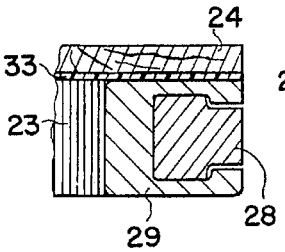
FIG 9
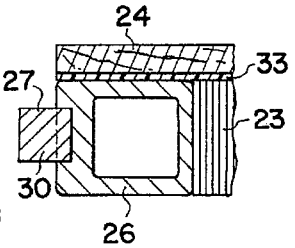
FIG 10
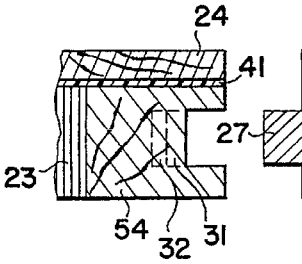
FIG 11
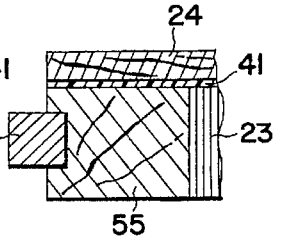
FIG 12
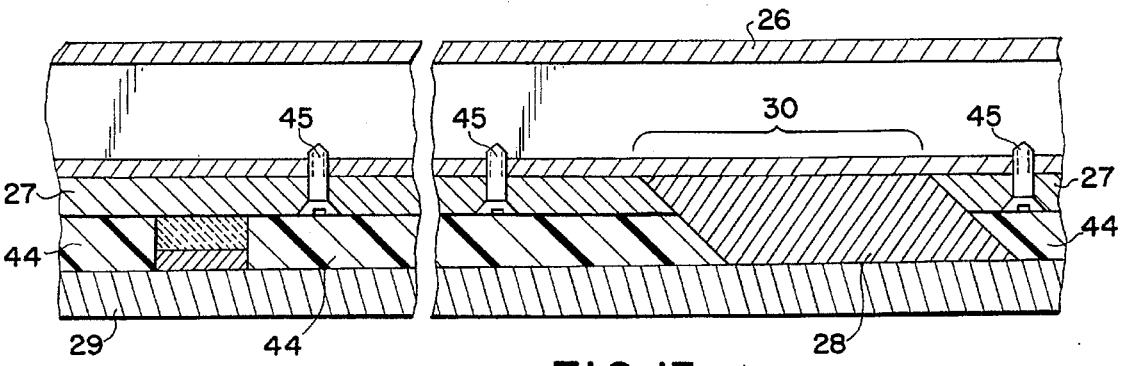
FIG 13

PORTABLE DANCE FLOOR

BACKGROUND OF THE INVENTION

There has for a long time been a need for a portable dance floor, which can be assembled and positioned wherever and whenever needed, and later can be readily disassembled and stored for later use. Hardwood flooring, preferred for dancing, is easily marred by those walking on it, and so it is not used as a permanent flooring where there is much foot traffic and only occasional dancing. In hotels and recreation centers, rooms for banquets or conferences are frequently carpeted from wall to wall to provide comfortable walking and to reduce noise. Dancing is not possible on carpets and accordingly a quick setup/break down dance floor is needed to accommodate dancing. Prior to now the available portable dance floors have had many flaws, principally relating to the means for joining sections so as to produce a level dancing surface, free of irregularities in height and spacing of adjoining sections. Other problems develop when Allen head screws used to join adjacent dance floor sections become too worn for the wrenches to work well and when threads become stripped.

It is an object of this invention to provide a novel portable dance floor. It is another object to provide a portable dance floor that has improved joining means between sections so as to produce a level top surface and perfect joining surfaces. Still other objects will become apparent from the more detailed description which follows.

BRIEF SUMMARY OF THE INVENTION

This invention relates to a portable dance floor comprising a plurality of assemblable identical square sections and a plurality of ramp members attachable to said sections to form a sloping perimeter around the dance floor, each said square section having a top horizontal surface, a bottom horizontal surface, and four vertical side surfaces including a generally square central core sheet of weight supporting material with a dance floor material covering its top surface, a structural beam portion around its perimeter to which are attached cooperating magnetic attraction means adapted to detachably join said square sections to each other and to detachably join said ramp members to said square sections.

In specific and preferred embodiments of this invention the dance floor sections have a light weight plastic honeycomb material as a core, a top surface of hardwood flooring and sides of wood, aluminum, or plastic beams to which are affixed magnets, wedge-shaped tongues, and recesses to provide a tight, accurately positioned coupling between adjoining sections.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 1 is a top plan view of the dance floor of this invention including four joined dance floor sections and ramps around the perimeter;

FIG. 2 is a side elevational view of the dance floor of FIG. 1;

FIG. 9 is a cross sectional view taken at 9—9 of FIG. 3 using metal structural beams;

FIG. 10 is a cross sectional view taken at 10—10 of FIG. 3 using metal structural beams;

FIG. 11 is a cross sectional view taken at 6—6 of FIG. 3 using wooden structural beams;

FIG. 12 is a cross sectional view taken at 8—8 of FIG. 3 using wooden structural beams;

FIG. 13 is a cross sectional view taken at area 37 of FIG. 1 looking vertically downward below the wooden dance flooring into the dance floor using metal beams;

DETAILED DESCRIPTION OF THE INVENTION

Figure 4:
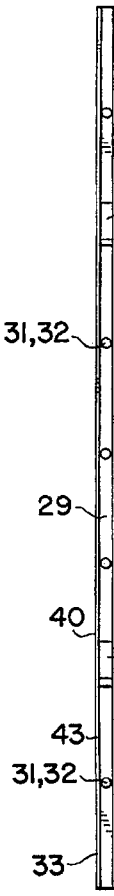
FIG. 4 is a side elevational view of the one section shown in FIG. 3.

This invention is best understood by refernece to the attached drawings,

In FIGS. 1–5 the general assembly and the component parts of the dance floor of this invention can be seen. The dance floor is made up of a plurality of square sections 20 abutting other identical sections to produce whatever shape is desired of the final assembly. Most of the time the final assembly is expected to be rectangular or square, although it can be imagined that the floor might be in the shape of the letter T or other simple shapes that can be produced by rearranging square sections 20. Inclined ramp sections 21 and 22 are attached to square sections 20 around the perimeter of the final dance floor. Square section has a top surface 38 which is a dancing surface, vertical sides and a bottom surface 40 which rests on whatever is under the dance floor assembly. Attached to the vertical sides on the outer perimeter of the assembly of sections 20 are ramp sections 21 and 22, which provide a sloping connection between the supporting floor and the top level of the assembled sections 20. This is not necessary for dancing purposes, but is a safety feature to prevent tripping or misstepping as one enters onto the dance floor or leaves it. There may be different precise designs of the ramp sections to accommodate different arrangements. For example, instead of the arrangement shown in FIG. 1 (4 center sections 21, 4 left hand sections 22, and 4 right hand sections 22) there may be no sections 21 and eight end sections 22, each long enough to cover one half the length of a side 42. If the dance floor is always the same size and shape, there may be four ramp sections, each being a combination of two end sections 22 and one center section 21.

Figure 3:
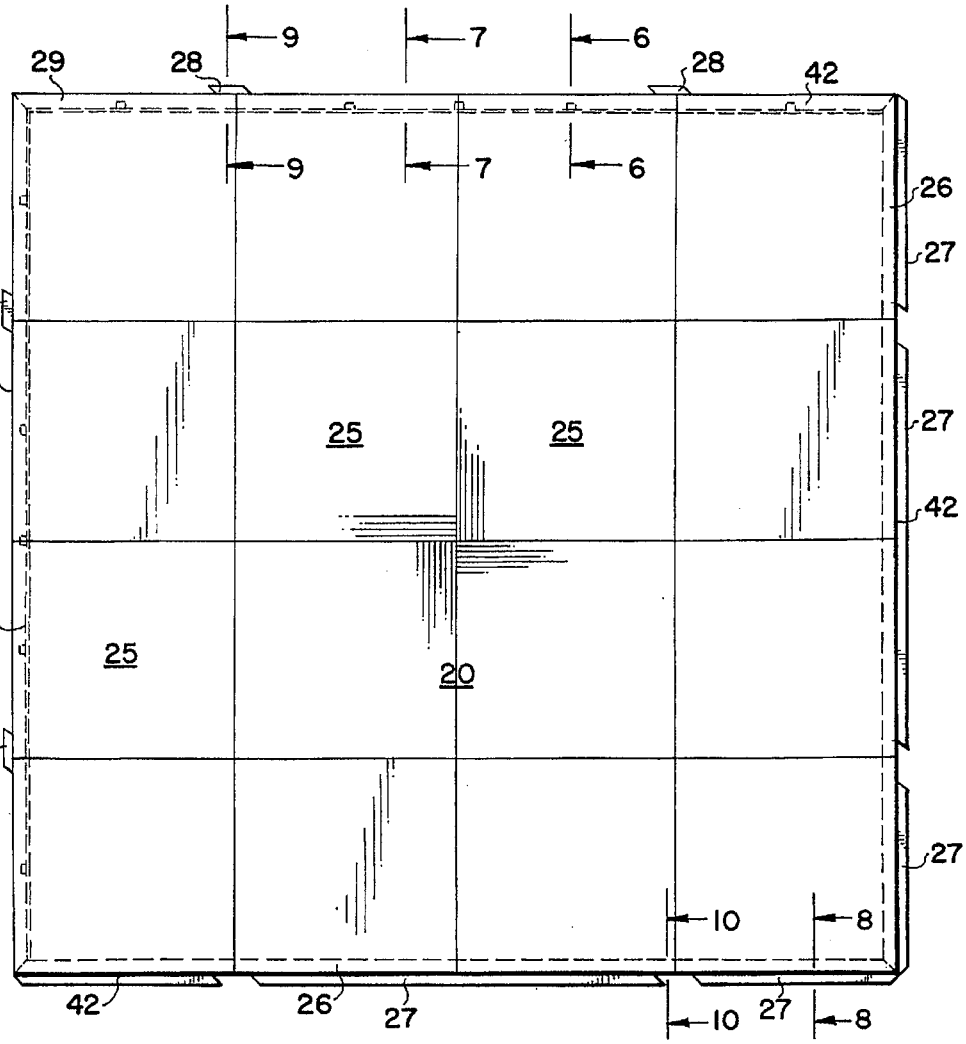
FIG. 3 is a top plan view of one dance floor section.
Figure 5:
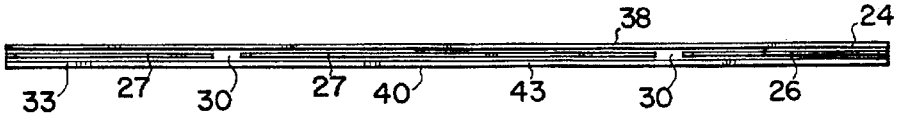
FIG. 5 is a front elevational view of the section shown in FIGS. 3–4.
Figure 6:
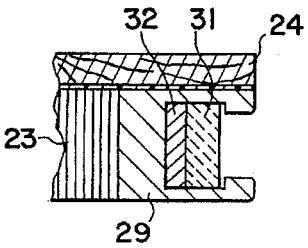
FIG. 6 is a cross sectional view taken at 6—6 of FIG. 3 using metal structural beams.
Figure 7:
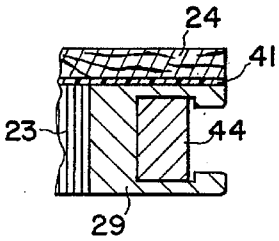
FIG. 7 is a cross sectional view taken at 7—7 of FIG. 3 using metal structural beams.

The structure of square sections 20 is shown in FIGS. 3–5. Each section 20 is identical to each other section 20 so as to provide facility in assembly by not having to sort out one type of section 20 from another. Each section 20 has a basic core sheet 23 of supporting material, which preferably is a manufactured sheet of light weight plastic honeycomb material with the axes of the honeycomb cells being vertical and with precisely flat and parallel top and bottom surfaces 38 and 40, and may be sawed as wood is sawed. Other core materials suitable are wood, metal, plastic, paper, fiberglass reinforced plastic in solid, honeycomb, or foamed structures, and the like. Attached to sides of core sheet 23 are lengths of beams 26 or 29, preferably wood or aluminum, but may alternatively be steel, plastic, or the like, to form finished vertical sides 42 of square sections 20. These two components, core sheet 23 and side beams 26 and 29 constitute the basic structure of the square sections 20. A moisture barrier sheet 41 is laid across core sheet 23 to prevent liquids from running into core sheet 23 from above, and to provide additional strength. A danceable flooring material 24, preferably hardwood parquet sections 25 is laid across top surface of moisture barrier sheet 41 to provide the best dancing surface. Other dance floor materials, such as tile, plastic sheet, etc. may be used, but are not preferred over waxed hardwood. A cover sheet 33 may be attached to the bottom surface of square section 20 to provide a protection against damaging the main floor supporting the dance floor, and also to protect the underside of the portable dance floor section 20. The main floor might be of any common building materials such as wood, metal, concrete, tile, stone, etc., uncovered or covered with carpeting. Cover sheet 33, if used, preferably is a plastic sheet or film, or a felt fabric.

The remaining components on each square section 20 are magnetic means for firmly attaching one square section 20 to the next abutting square section 20. Other additional components include wedge lock means for aligning square sections 20 properly and preventing them from sliding laterally and dowel or tongue means for aligning ramp sections 21 and 22 with square sections 20.

FIGS. 6–12 show beams which are attached to the outer perimeter of central core 23 and provide means for attachment of the components to clamp adjacent square sections 20 together in proper alignment. Beams 26 and 29 are metal or plastic beams in FIGS. 6–10.

Figure 8:
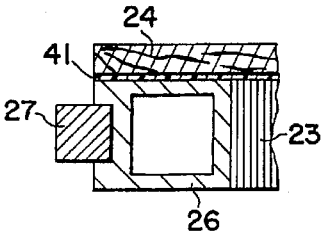
FIG. 8 is a cross sectional view taken at 8—8 of FIG. 3 using metal structural beams.

Beams 54 and 55 are wooden beams in FIGS. 11–12. Beams 26 are square hollow tubing and beams 55 are solid wooden square beams, each having a groove on the outside vertical face opposing the next abutting square section 20. The groove is for seating a ferrous, preferably iron or steel, strip or rib 27 which will cooperate with magnets on the abutting square section 20 to make a tight coupling. Strip 27 is attached to beam 26 or 55 by screws (see FIG. 13)45, or in the case of wooden beams 55 may be cemented into place. Beam 29 is an aluminum channel and beam 54 a wooden channel, each with the open side of the channel facing beam 26 or 55, respectively, and steel rib 27 of the next abutting square section 20. In channel of beam 29 or 55 a plurality of magnets 31 and backing buttons 32 are spaced over the entire length of the beam. Between adjacent magnets 31 and backing buttons 32 are nonmagnetic spacers 44 to maintain the desired spacing of the magnets 31 when in an aluminum channel. In the wooden beam 55 each magnet 31 and its backing button 32 is cemented into a countersunk hole in the beam. Preferably, magnets 31 are ceramic magnets made from rare earth elements. These magnets are very strong and have a long life. Backing buttons 32 are ferrous materials, like that of strip or rib 27, and their function is to strengthen the magnetic attraction field, which occurs merely by being in contact with magnet 31. These components are positioned, being of the appropriate size, to slidingly fit into the channel of metal beam 29, when such is used. There may, of course, be added, if desired, a more positive attachment than friction; for example, cement, rivets, screws, or the like. As may be seen in comparing FIGS. 6 and 11 with FIGS. 8 and 12, magnet 31 is recessed inwardly from the outside surface of the beam 29 or 54 (FIGS. 6 and 11) and strip or rib 27 projects outwardly from the outside surface of beams 26 and 55 (FIGS. 8 and 12). The recess in FIGS. 6 and 11 matches the projection in FIGS. 8 and 12, such that when magnet 31 and rib 27 are in contact, the corresponding outer faces of beams 26 and 29 (in the metal configuration) or 55 and 54 (in the wooden configuration) are also in contact. For a square section of about four feet on a side, there may be used four to eight magnets 31 spaced along the four foot side.

Beams 54 and 55 (FIGS. 11 and 12) are the wooden counterparts to beams 29 and 26 (FIGS. 6–10). The same combination of magnet 31 and backing button 32 are used in beam 54 as that of metal beam 29 in FIG. 6. However, magnet 31 and button 32 in FIG. 11 are cemented into a countersunk hole so as to prevent lateral sliding and also to elmininate the need for a spacer 44. In FIG. 12 beam 55 is a square or rectangular beam with a shallow groove on one face to accept iron or steel strip 27. Strip 27 may be screwed, cemented, or otherwise affixed to beam 55 to make it the counterpart of the metal or plastic combination of FIG. 8.

The wedge lock means for aligning two square sections 20 and preventing them from lateral sliding comprises a plurality of wedge-shaped tongues 28 in beams 29 and 54 mating with a plurality of wedge-shaped recesses 30 in strip 27 in beams 26 and 55 along plane 53 between sections 20 and ramps 21 or 22. The tongues 28, usually two being present on a side 42 of square section 20, are shaped to fit the channel of beams 29 and 54 and are slid into place with a section of spacer 44 on each end of tongue 28 in metal beam 29 or are cemented in place in wooden beams 54 (See FIGS. 9, 13, 14 and 18). Wedge shaped recesses 30 are the result of interrupting rib 27 with a space, bevelled at each end to fit the cooperating wedge-shaped tongue 28 (See FIGS. 3, 5, 13 and 14). It is easily seen that with tongues 28 in place, two abutting sections 20 may not slide laterally with respect to each other. Tongues 28 are preferably made of steel, like spacers 44 or may be made of wood. FIG. 13 is a cross sectional view looking downwardly in area 37 in FIG. 1 with the dance floor material removed. FIG. 13 shows the relationships of beams 26 and 29, magnets 31, backing buttons 32, spacers 44, tongues 28, rib 27 and recesses 30.

Figure 14:
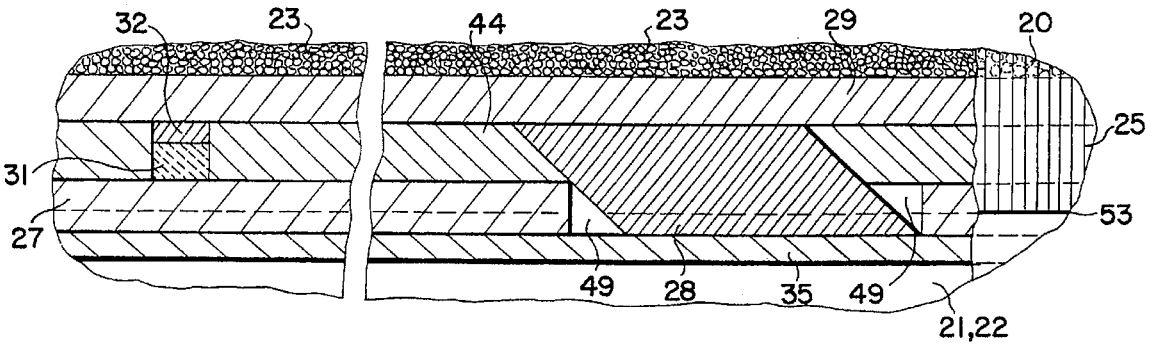
FIG. 14 is a cross sectional view taken at 14—14 of FIG. 1 using metal beams.
Figure 15:
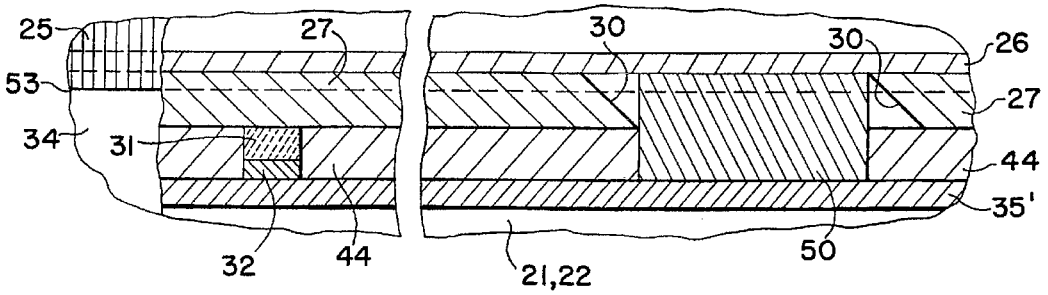
FIG. 15 is a cross sectional view taken at 15—15 of FIG. 1 using metal beams.
Figure 16:
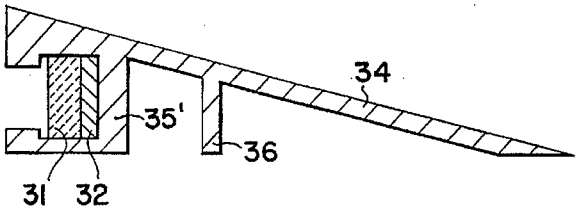
FIG. 16 is a cross sectional view taken at 16—16 of FIG. 2 using metal ramp sections.
Figure 17:
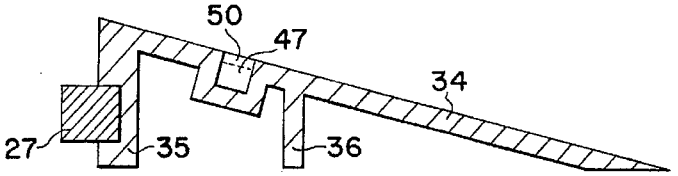
FIG. 17 is a cross sectional view taken at 17—17 of FIG. 2 using metal ramp sections.
Figure 18:
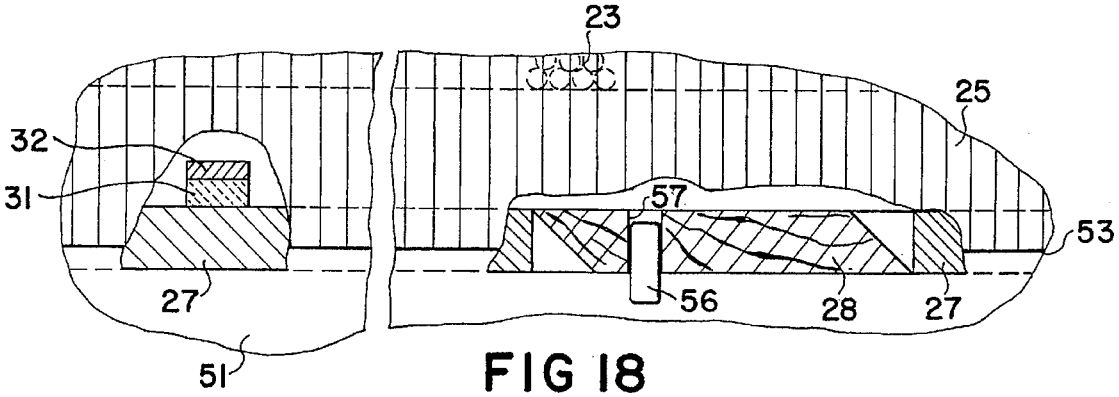
FIG. 18 is a cross sectional view taken at 14—14 of FIG. 2 using wooden beams.
Figure 19:
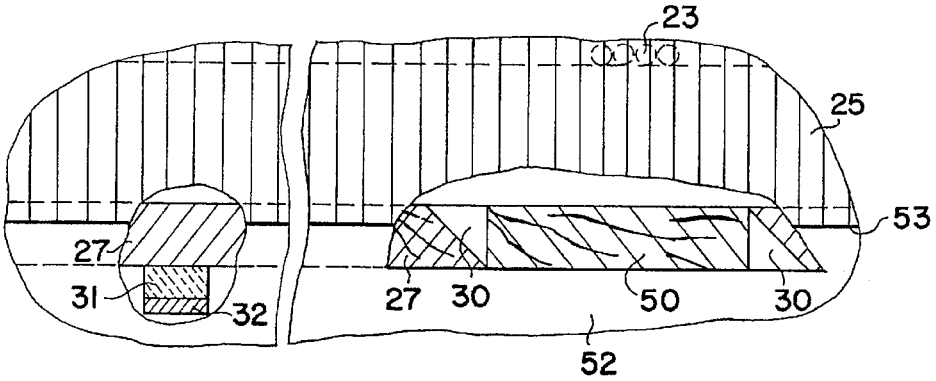
FIG. 19 is a cross sectional view taken at 15—15 of FIG. 2 using wooden beams.
Figure 20:
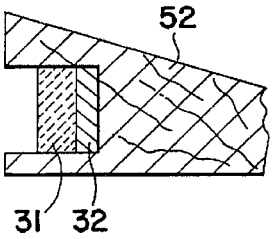
FIG. 20 is a cross sectional view taken at 16—16 of FIG. 1 using wooden ramp sections.

Ramp members 21 and 22, made of metal, are fashioned to mate with the components in metal beams 26 and 29. Ramp members 51 and 52, made of wood, are fashioned to mate with the components in wooden beams 54 and 55. It is, of course, entirely appropriate to mix metal beams with wooden ramps or wooden beams with metal ramps. FIG. 16 shows a ramp section having a channel beam face as in FIG. 6 and containing magnets 31 and backing buttons 32 in leg 35', support leg 36, and spacers 44 arranged as described above with respect to channel 29. FIG. 17 shows a ramp section having a face 35 similar to that of beam 26 in FIG. 8 and including rib 27 with square-shaped recesses 49. No ramp section 21 or 22 contains a wedge-shaped tongue 28 or a wedge shaped slot recess 30. However, in order to provide a better stability and alignment, ramps 21 and 22 contain a square recess 49 or a square tongue 50 to mate with a wedge-shaped tongue 28 or a wedge-shaped slot recess 30 in square section 20. FIGS. 14 and 18 illustrate the mating of a wedge-shaped tongue 28 on a square section 20 with a square recess 49 on ramp section 21, 22 or 51. FIGS. 15 and 19 illustrate a wedge-shaped recess 30 on square section 20 mating with a square tongue 50 on ramp sections 20, 21 or 52. These combinations are effective in preventing lateral sliding of a square section 20 with respect to a ramp section 20, 21, 51 or 52.

An additional aligning means that has been employed and found to be acceptable is the use of one or more dowels 56 on ramp sections 20, 21, 51 or 52 to mate with dowel alignment holes 57 on square section 20 or one of its components, such as wedge-shaped tongue 28 as illustrated in FIG. 18.

Figure 21:
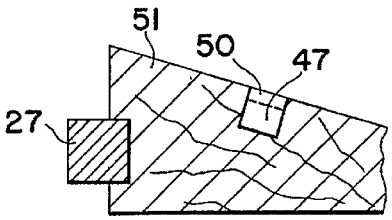
FIG. 21 is a cross sectional view taken at 17—17 of FIG. 1 using wooden ramp sections.

It is also a preferred addition to employ a light in each ramp section 21, 22, 51 or 52 as illustrated in FIGS. 17 and 21. A groove in the face 34 of the ramp is fitted with an end illuminated translucent rod 47, or alternatively, light bulbs are placed along the groove and a translucent cover plate 50 is placed flush with the top surface of the ramp section.

While the invention has been described with respect to certain specific embodiments, it will be appreciated that many modifications and changes may be made by those skilled in the art without departing from the spirit of the invention It is intended, therefore, by the appended claims to cover all such modifications and changes as fall within the true spirit and scope of the invention.

I claim:

1. A portable dance floor comprising a plurality of assemblable identical square sections and a plurality of ramp members attachable to said sections to form a sloping perimeter around the dance floor, each said square section having a top horizontal surface, a bottom horizontal surface and four vertical side surfaces and including a generally square central core sheet of weight supporting material with a dance floor material covering its top surface, a structural beam portion around the perimeter of said square sections to which are attached cooperating magnetic attraction means to detachably join each said square section to each adjacent said square section and to detachably join said ramp members to adjacent said square sections; and said structural beam also including a plurality of outwardly projecting wedge-shaped tongues spaced longitudinally along said beam, which tongues interlock with similarly sized wedge-shaped recesses spaced longitudinally along the respective structural beam portion of the next contiguous said square section, said tongues and said recesses interlocking in a male/female mating arrangement.

2. The dance floor of claim 1 wherein said magnetic means includes magnets attached to said beam portion on one said square section and magnetically attractive material attached to the facing beam portion of the next adjacent square section.

3. The dance floor of claim 1 wherein said central core is a sheet of plastic honeycomb material, said dance floor material is an assembly of hardwood strips, and said beam portions are lengths of aluminum structural beams.

4. The dance floor of claim 1 wherein two adjoining said vertical side surfaces include an outwardly projecting horizontal magnetically attractive steel strip interrupted by a plurality of spaced wedge-shaped slot recesses, and the other two adjoining said vertical surfaces include an aluminum structural channel with the open side of said channel facing outwardly and containing a plurality of outwardly projecting wedge-shaped tongues and a plurality of spaced magnet members, the spacing of said tongues corresponding with the spacing of said slot recesses.

5. The dance floor of claim 4 wherein said magnet members are ceramic magnets.

6. The dance floor of claim 3 wherein said ramp portions are aluminum extrusions.

7. The dance floor of claim 1 which additionally comprises a moisture barrier sheet between said core sheet and said dance floor material.

8. The dance floor of claim 1 which additionally includes an illumination means in each said ramp member.

9. The dance floor of claim 1 wherein said beam portions and said ramp members are wood.

10. A portable dance floor comprising an assembly of a plurality of disassemblable identical square sections and a plurality of disassemblable ramp sections around the perimeter of the dance floor; each said square section having a central core of weight supporting honeycomb material, a top layer of hardwood flooring and four lateral sides of structural beams, two of adjacent said sides having an outwardly projecting horizontal steel rib interrupted by a plurality of spaced wedge-shaped slot recesses; and the other two adjacent said sides being U-shaped channel members having an array of a plurality of magnet members attached to the open side of said channel and adapted to contact said steel rib, and a plurality of spaced wedge-shaped tongues adapted to mate with said slot recesses in a male/female coupling; said ramp sections having sloping upper surfaces to connect the top layer of hardwood flooring to the surface upon which said dance floor rests, said ramp sections having a vertical face with projections and recesses to fit in a male/female coupling with those of the square sections to which the respective ramp section is attached.

11. The dance floor of claim 10 wherein said ramp sections include a rectangular square-end tongue projecting outwardly from their facings to mate with each wedge-shaped slot recess in the sides of said square sections in a male/female coupling.

12. The dance floor of claim 10 which additionally comprises a thin moisture barrier, penetration-resistant sheet material between said layer of dance flooring and said honeycomb core material.

13. The dance floor of claim 10 wherein each said ramp section includes a horizontal illumination means, below the surface of the ramp section and adapted to illuminate the surface of said ramp section.

14. The dance floor of claim 10 wherein said structural beams are metal.

15. The dance floor of claim 13 wherein said metal is aluminum.

16. The dance floor of claim 10 wherein said structural beams and said ramp sections are wood.

17. The dance floor of claim 10 wherein said ramp sections are metal.

18. The dance floor of claim 10 wherein said metal is aluminum.

19. The dance floor of claim 10 wherein said ramp sections are wood.

20. The dance floor of claim 10 wherein said magnet members are ceramic magnets.

* * * * *